US008753254B2

(12) United States Patent
Horbach et al.

(10) Patent No.: US 8,753,254 B2
(45) Date of Patent: Jun. 17, 2014

(54) CENTRIFUGE HAVING A DRUM INCLUDING A PLURALITY OF SUPPLY PIPES EACH HAVING A RADIALLY EXTENDING SECTION AND A CURVED SECTION

(75) Inventors: Ulrich Horbach, Hamm (DE); Rüdiger Göhmann, Oelde (DE)

(73) Assignee: GEA Mechanical Equipment GmbH, Oelde (DE)

( * ) Notice: Subject to any disclaimer, the term of this patent is extended or adjusted under 35 U.S.C. 154(b) by 0 days.

(21) Appl. No.: 13/642,037

(22) PCT Filed: Apr. 19, 2011

(86) PCT No.: PCT/EP2011/056275

§ 371 (c)(1), (2), (4) Date: Nov. 14, 2012

(87) PCT Pub. No.: WO2011/138167

PCT Pub. Date: Nov. 10, 2011

(65) Prior Publication Data

US 2013/0053231 A1 Feb. 28, 2013

(30) Foreign Application Priority Data

May 3, 2010 (DE) ..... 10 2010 016 740

(51) Int. Cl.
*B04B 15/06* (2006.01)

(52) U.S. Cl.
USPC ..... 494/29

(58) Field of Classification Search
USPC ..... 494/27–30
See application file for complete search history.

(56) References Cited

U.S. PATENT DOCUMENTS

| | | | | | |
|---|---|---|---|---|---|
| 1,714,232 | A | * | 5/1929 | Morris | 239/97 |
| 1,886,111 | A | * | 11/1932 | Lorentsen | 494/27 |
| 1,926,402 | A | * | 9/1933 | Pearce | 210/210 |
| 2,518,436 | A | * | 8/1950 | Strezynski | 494/27 |
| 2,612,314 | A | * | 9/1952 | Huelsdonk | 494/30 |
| 3,302,873 | A | * | 2/1967 | Kowata | 494/27 |
| 4,286,748 | A | * | 9/1981 | Bailey | 494/29 |
| 4,299,352 | A | * | 11/1981 | Erickson | 494/27 |
| 4,406,651 | A | * | 9/1983 | Dudrey et al. | 494/29 |

(Continued)

FOREIGN PATENT DOCUMENTS

| | | | | | |
|---|---|---|---|---|---|
| DE | 11 20 261 | | | 6/1958 | |
| GB | 2121325 | A | * | 12/1983 | B04B 15/06 |
| JP | 59032967 | A | * | 2/1984 | B04B 15/06 |

OTHER PUBLICATIONS

German Office Action for Application No. 10 2010 016 740.1, dated Sep. 20, 2011.

*Primary Examiner* — Charles E Cooley
(74) *Attorney, Agent, or Firm* — Crowell & Moring LLP

(57) ABSTRACT

A centrifuge having a vertical axis of rotation. The centrifuge includes a rotatable drum configured to process an inflowing suspension, the rotatable drum including an assembly configured to supply a washing liquid into an interior of the drum. The centrifuge also includes a plurality of supply pipes arranged in the drum and configured to conduct the washing liquid into the interior of the drum. Each of the supply pipes have a section extending radially within the drum and a curved section adjoining thereon at a radially distal end of the supply pipes proximate an inner wall of the drum.

5 Claims, 5 Drawing Sheets

(56) References Cited

U.S. PATENT DOCUMENTS

| | | | | |
|---|---|---|---|---|
| 4,769,133 | A * | 9/1988 | Brookes et al. | 210/86 |
| 4,846,780 | A * | 7/1989 | Galloway et al. | 494/3 |
| 5,908,376 | A * | 6/1999 | Macaluso et al. | 494/29 |
| 6,102,843 | A * | 8/2000 | Kelley et al. | 494/29 |
| 7,448,992 | B2 * | 11/2008 | Grimwood et al. | 494/29 |
| 8,574,143 | B2 * | 11/2013 | Astheimer et al. | 494/26 |
| 2003/0008758 | A1 * | 1/2003 | Astheimer et al. | 494/29 |
| 2013/0053231 | A1 * | 2/2013 | Horbach et al. | 494/29 |

* cited by examiner

CENTRIFUGE HAVING A DRUM INCLUDING A PLURALITY OF SUPPLY PIPES EACH HAVING A RADIALLY EXTENDING SECTION AND A CURVED SECTION

CROSS-REFERENCE TO RELATED APPLICATION

This application is a national stage of International Application PCT/EP2011/056275, filed Apr. 19, 2011, and claims benefit of and priority to German Patent Application No. 10 2010 016 740.1, filed May 3, 2010, the content of which Applications are incorporated by reference herein.

BACKGROUND AND SUMMARY

The present disclosure relates to a separator, for example, a nozzle separator, or a centrifuge. The nozzle separator, or centrifuge, includes a vertical axis of rotational and a rotatable drum configured to process an inflowing suspension. The rotatable drum includes an assembly configured to supply a washing liquid into an interior of the drum and at least one supply pipe arranged in the drum and configured to conduct the washing liquid into the interior of the drum Methods are known under the concept "replacement wash", in which a washing liquid is conducted into the drum interior using recirculation lines which extend outward radially in the drum interior, so that this washing liquid has a radial speed component and an axial speed component upon entry into the drum interior. The solid phase separated from the mother solution is absorbed by the washing solution and ejected as the washed washing suspension from the drum via nozzles as the nozzle phase (see FIG. 2).

This procedure has fundamentally proven itself. However, appearances of mixing of the detergent phase with the surrounding solid-charged liquid or suspension result, since the freshly "injected" washing liquid is lighter than the surrounding solid-charged liquid and is, therefore, deflected radially inward.

Embodiments of the present disclosure address this problem of deflecting the washing liquid inward.

The present disclosure thus relates to a centrifuge having a vertical axis of rotation. The centrifuge includes a rotatable drum configured to process an inflowing suspension. The rotatable drum includes an assembly configured to supply a washing liquid into an interior of the drum and at least one supply pipe arranged in the drum and configured to conduct the washing liquid into the interior of the drum. The supply line is arranged such that the washing liquid exits from the supply line with a velocity component in a peripheral rotational direction. A method for diverting a solid phase from a centrifuge includes the step of using the centrifuge.

Through the step of deflecting the washing liquid in the peripheral rotational direction and the application of a velocity component in the peripheral rotational direction connected thereto, multiple advantageous effects are achieved, which reduce the problem described above.

The radial exchange of fresh washing solution and suspension is thus opposed with an elevated resistance. Because of the additional peripheral velocity, the centrifugal force on the washing liquid is increased. The liquid having greater specific gravity can no longer displace the washing liquid entirely or partially inward.

Through the deflection of the washing liquid stream in the peripheral rotational direction, among other things, packing and similar structures on the inner wall of the drum can be omitted. This results in a structural simplification of the centrifuge and also enlarges the usable drum volume.

Sedimentations of solids between the solid discharge nozzles are flushed in the direction of these nozzles.

It is within the scope of the present disclosure that a part of the required solid discharge nozzles can be omitted, which reduces the machine costs and the danger of clogging.

The gravity field is amplified by the additional peripheral velocity, according to the present disclosure.

The outlet openings of the supply pipes may, for example, in accordance with the present disclosure, lie in the peripheral direction between the solid discharge openings to achieve a particularly good effect, as described above. Alternatively, however, it is within the scope of the present disclosure that they can also lie radially as an extension of the outlet openings.

Embodiments of the present disclosure are discussed herein, including the appended claims.

Other aspects of the present disclosure will become apparent from the following descriptions when considered in conjunction with the accompanying drawings.

DETAILED DESCRIPTION

Figure 2:
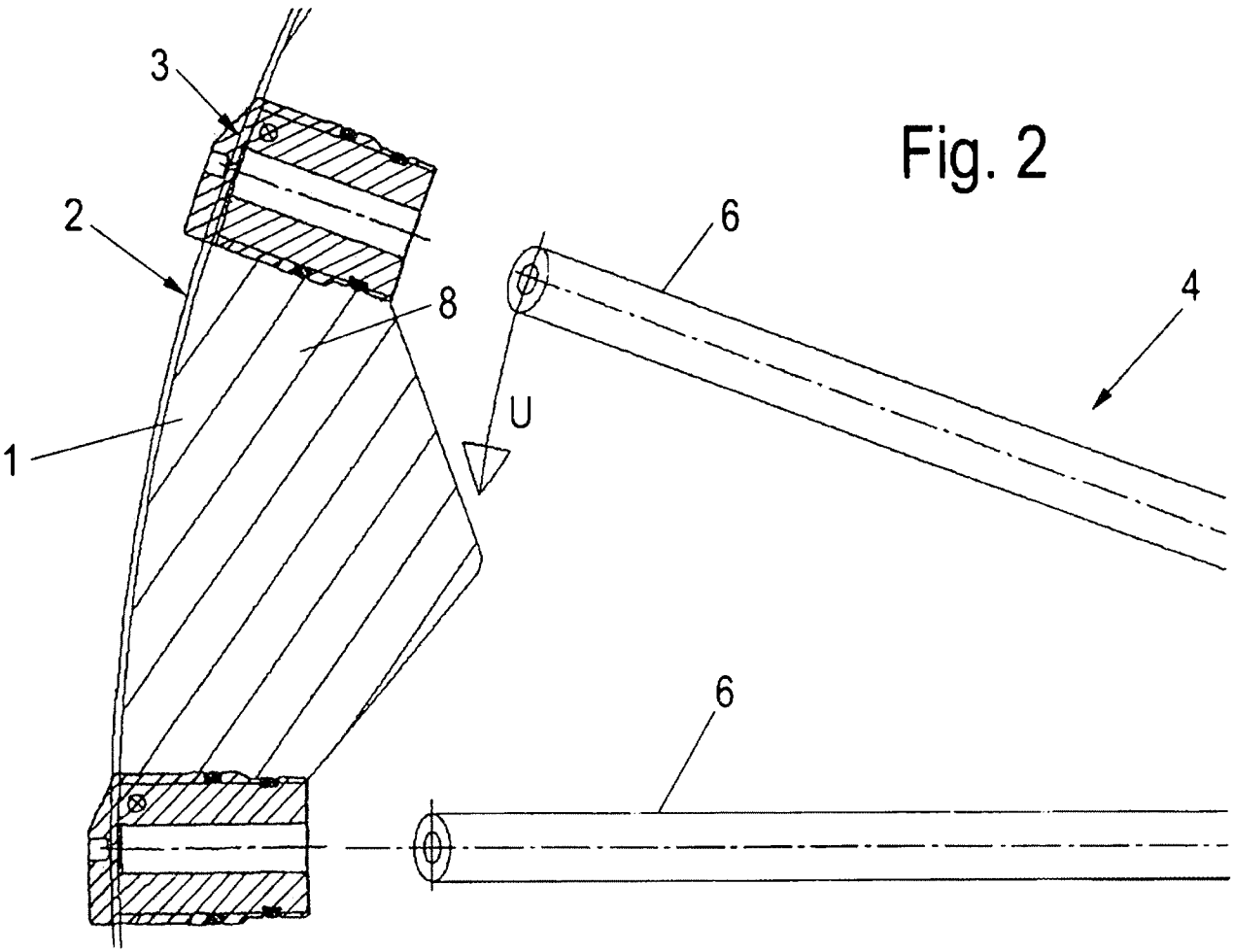
Fig. 2 PRIOR ART
FIG. 2 shows a view similar to FIG. 1 but of a known centrifuge drum.

FIG. 2 shows a section through a lower part 1 of a separator drum 2, which is known and is designed as a nozzle drum for continuous operation, and having vertical rotational axis.

To divert a solid phase, the separator drum 2 has solid discharge nozzles 3 in the region of its largest diameter.

The nozzle drum 2 is rotatable by a drive (not shown) and has, in addition to the components shown in FIG. 2, an intake for a suspension to be processed, such as a plate packet made of separating plates, and one or more units for diverting at least one liquid phase. Such units are routine to a person skilled in the art and do not require any further explanation here.

In addition to the intake for the suspension to be processed, the separator drum 2 has an assembly 4 for feeding washing liquid into the drum interior.

This assembly 4 has an intake for washing liquid (not shown), which can be formed concentrically to the intake, or pipe, for the suspension to be processed, for example.

The intake for washing liquid opens into a distributor 5 (see FIG. 3), which has a plurality of peripherally-distributed outlet openings, which open into supply lines 6. The supply lines 6 extend radially outward in the drum 2 for distributing and supplying the washing liquid in the drum interior.

The distributor or supply pipes 6 extend radially outward in the drum 2 up to shortly before the solid discharge nozzles 3 in the drum wall 8, according to the prior art of FIG. 2. Wall reinforcements, are arranged peripherally distributed between adjacent solid discharge nozzles 3, which protrude into the interior of the separator drum 2 and which deflect washing liquid exiting from the inlet pipes 6 in the direction of the solid discharge nozzles 3.

The supply lines 6 for the washing liquid are used for the purpose of conducting the washing liquid, at least a washing acid having a lower specific gravity, into the drum interior in the region shortly in front of the solid discharge nozzles 3.

As discussed herein related to the prior art, in addition to the expected deflection of the jet of the washing liquid, undesirably strong mixing with the suspension contained in the separator drum 2 can occur, since the freshly added washing liquid is lighter than the surrounding, solid-charged liquid or the suspension, so that the washing liquid is deflected inward. A passage of the washing liquid into an upper course results therefrom, whereby the effectiveness of the washing is impaired.

Figure 1:
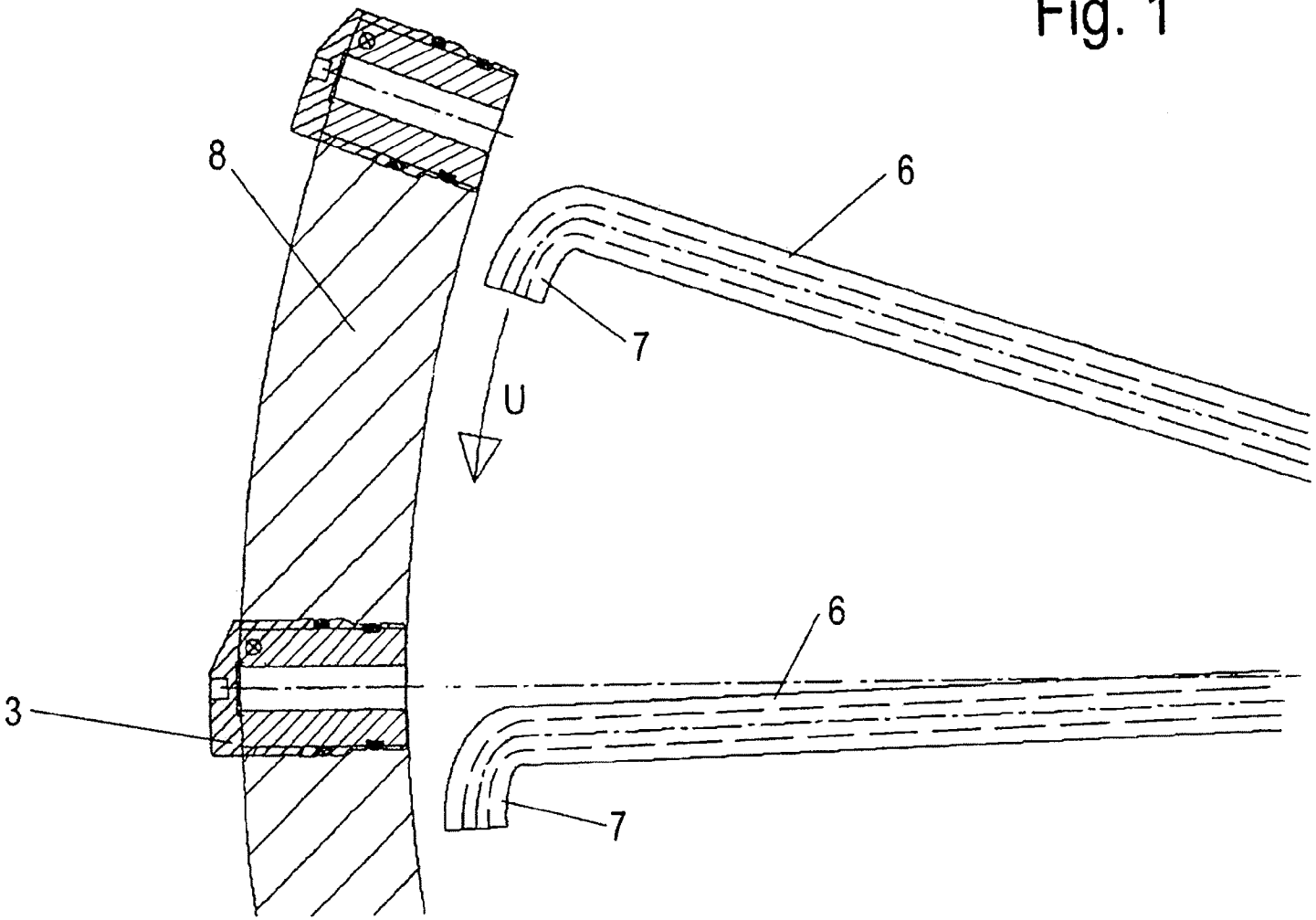
FIG. 1 shows a section through a portion of a centrifuge drum perpendicularly to the rotational axis, in accordance with the present disclosure.
Figure 3:
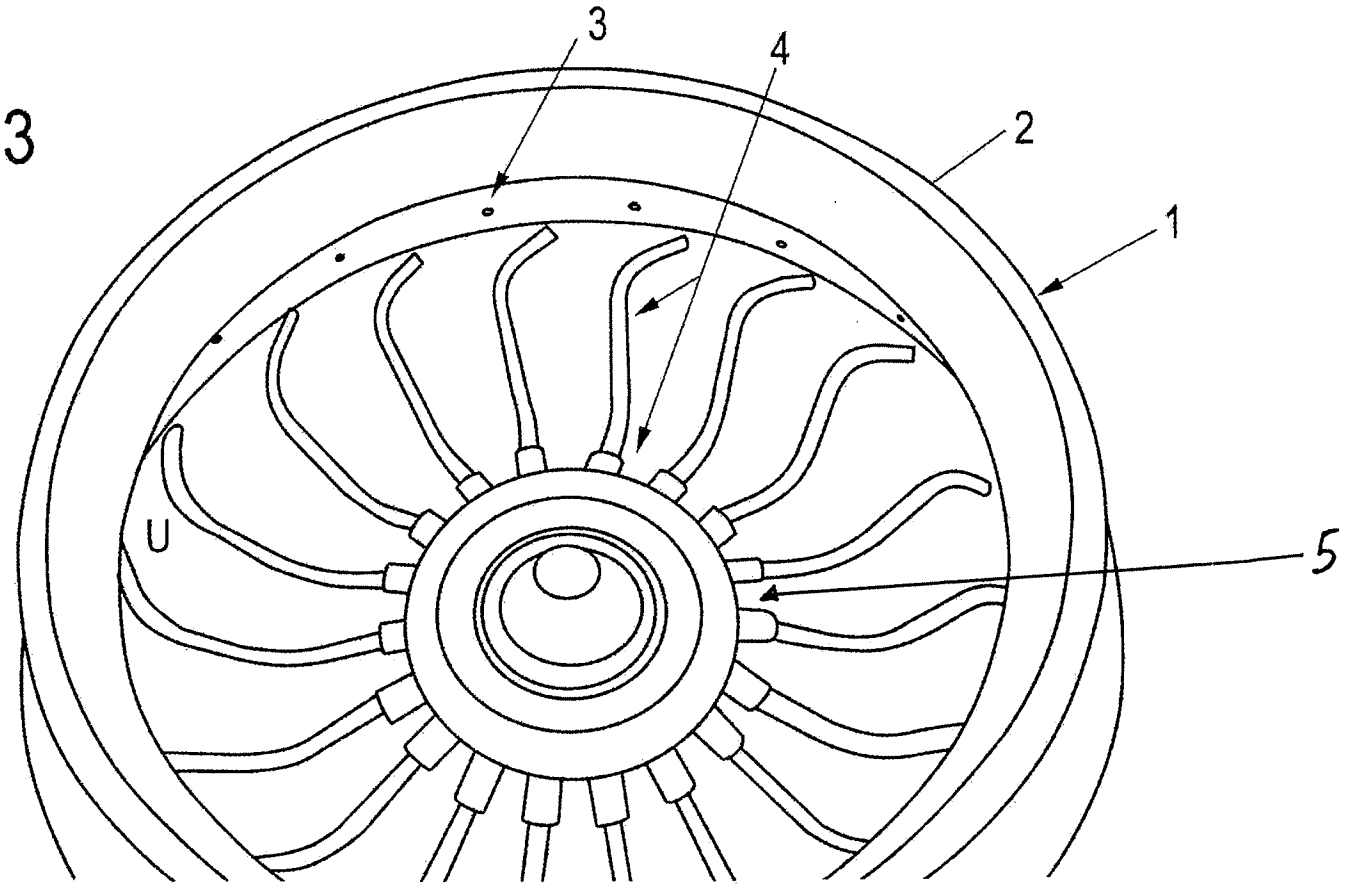
FIG. 3 shows a perspective view of the centrifuge drum of FIG. 1, in accordance with the present disclosure.

In order to counteract this effect, an embodiment according to the present disclosure, is provided and shown in FIGS. 1 and 3. According to this embodiment, the washing liquid is conducted into the drum interior in such a manner that it has a velocity component in the peripheral rotational direction U upon exit from the intake pipe.

It is advantageous and within the scope of the present disclosure to provide the supply pipes 6, which first extend radially outward in the drum interior, with a curved deflection section 7 in their radial outer region. Such section 7 is used for the purpose of deflecting the washing liquid from the radial direction in the peripheral rotational direction U.

This deflection section 7 is formed, as shown in FIG. 1, as a 90° pipe curve, the exit opening of the pipe curve being oriented in the peripheral rotational direction U. This is so that the washing liquid leaves the deflection device in the peripheral rotational direction U.

Figure 4:
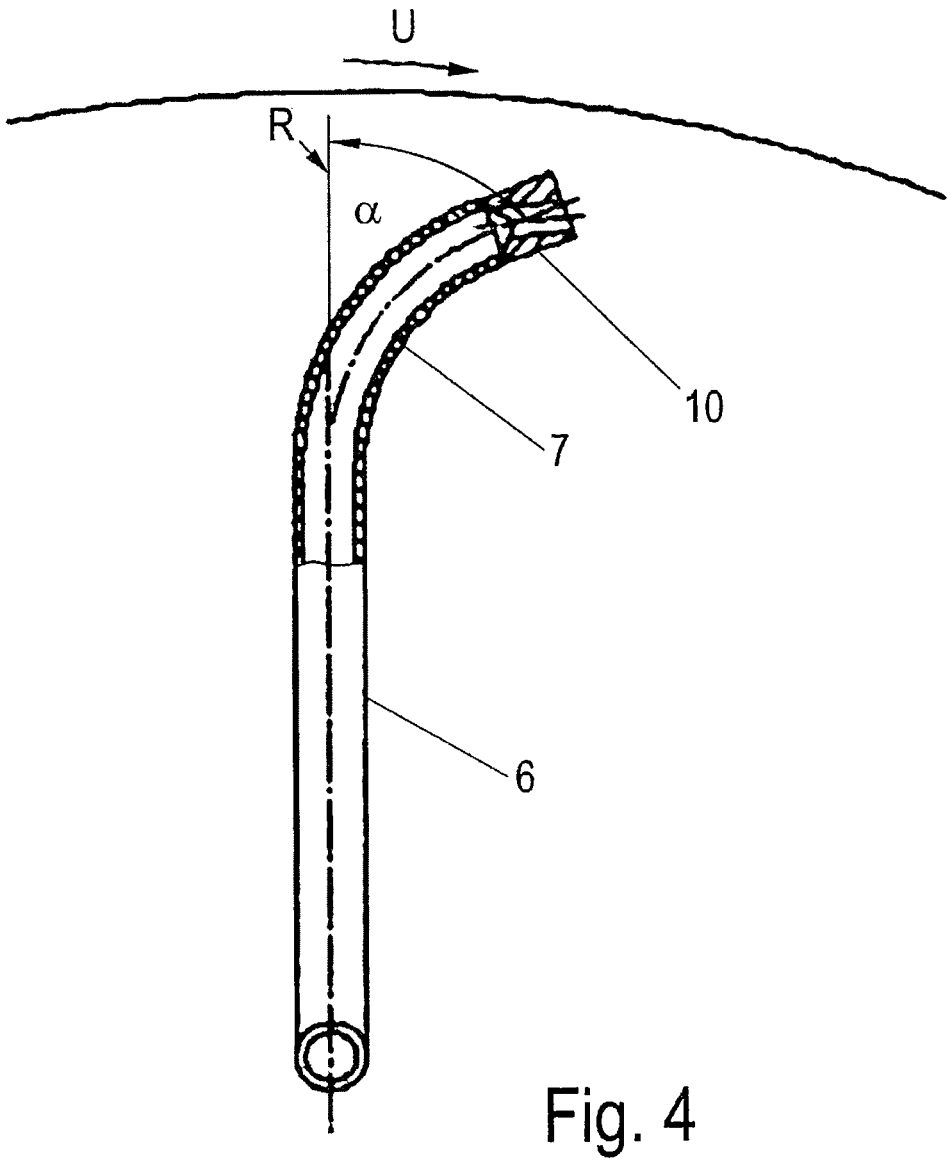
FIG. 4 shows a partial cutaway view of a supply pipe, in accordance with the present disclosure.

As is shown in FIG. 4, an exit nozzle 10 can, according to the present disclosure, be arranged on the end of each supply pipe 6.

The deflection angle $\alpha$, in the peripheral rotational direction U from the radial direction R, may, for example, be between 45° and 120° (see FIG. 4).

In contrast to the drum structure of FIG. 2, the separator drum 2 according to the present disclosure, no longer has packing on its inner wall. Thus, the inner periphery is formed circularly or cylindrically.

During a washing method, firstly washing liquid, for example, a washing acid having a lighter specific gravity, is guided through the inlet pipes 6 in the edge region of the interior of the separator drum 2, where it exits in the peripheral rotational direction U from the inlet pipes 6 into the drum interior.

A method for diverting a solid phase from a centrifuge includes the step of using a centrifuge having a vertical axis of rotation. The centrifuge includes a rotatable drum configured to process an inflowing suspension. The rotatable drum includes an assembly configured to supply a washing liquid into an interior of the drum and at least one supply pipe arranged in the drum and configured to conduct the washing liquid into the interior of the drum. The supply line is arranged such that the washing liquid exits from the supply line with a velocity component in a peripheral rotational direction.

Figure 5:
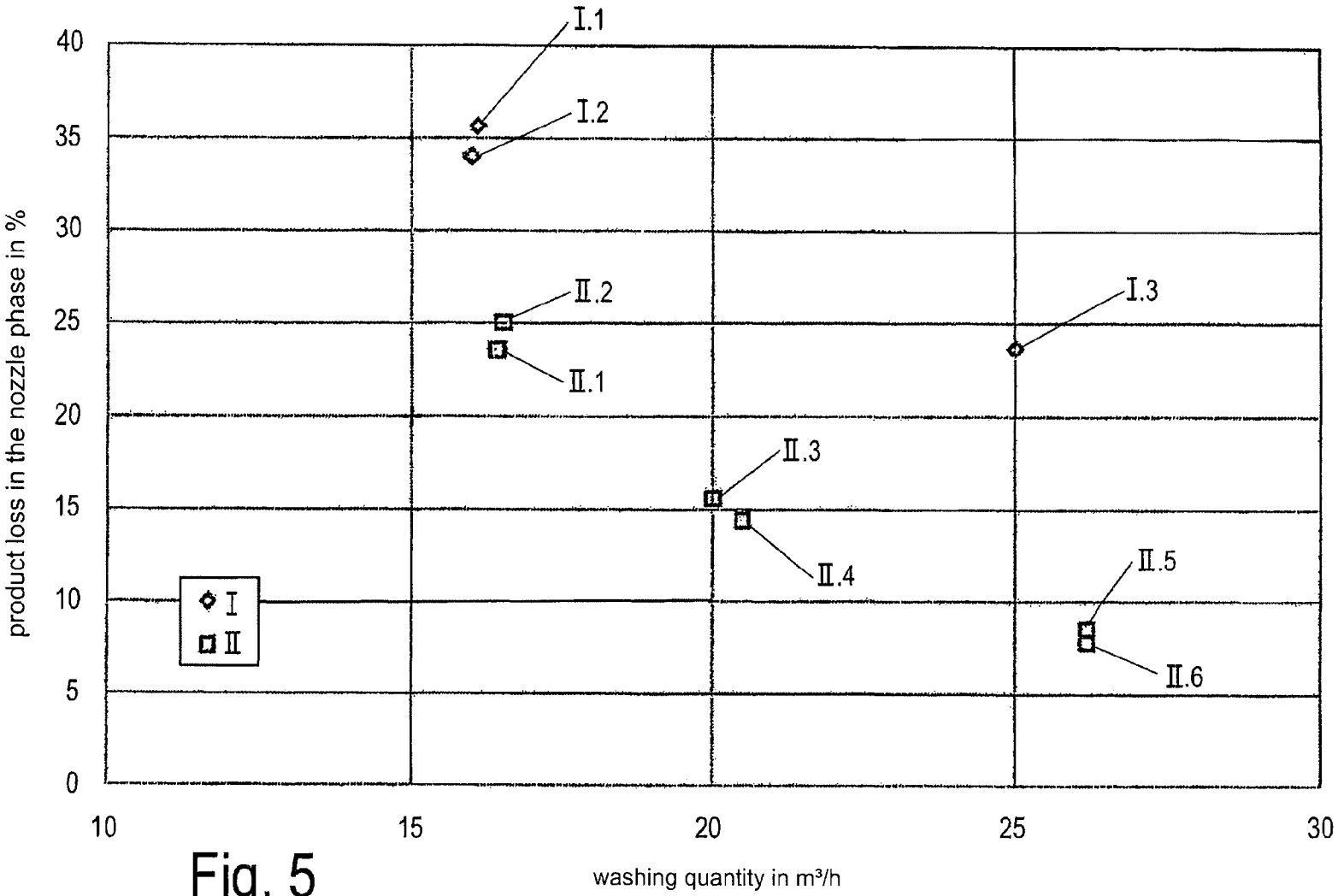
FIG. 5 shows a graph which illustrates a product loss in % with respect to a washing quantity in $m^3/h$, in accordance with the present disclosure.

FIG. 5 shows a graph of the product loss in the nozzle phase in % over the washing quantity in $m^3/h$.

Experiments were carried out in a separator DC 130 in accordance with the present disclosure. A highly concentrated salt solution was admixed to the product intake as a tracer and subsequently the salt concentration was determined in the upper course, or the gripper phase, and lower course, or the nozzle phase, respectively. A complete mass balance could thus be carried out in the separator.

The previously known assembly I (see FIG. 5) for supplying washing liquid and the assembly II (see FIG. 5) according to the present disclosure were compared, the measured values for the known assembly being shown by diamonds I.1-I.3 and the measured values for the assembly according to the present disclosure being shown by squares II.1-II.6.

In the previously known assembly for supplying washing liquid (see FIG. 2), the ratio in which the respective quantities were allocated to the upper course and lower course were strongly influenced by the densities of the washing liquid and the product stream. These are dependent on the salt content. If the washing liquid is heavier than the product liquid, no noticeable mixing occurs in the known assembly I.

Upon the observation of the measured values of the assembly II according to the present disclosure, it could be established, in accordance with the present disclosure, that the loss of liquid product, as can occur through the mixing of the heavier liquid product phase with the lighter washing liquid, is decreased with increasing washing quantity.

Although the radial mixing could not be completely precluded even with the supply of the lighter washing liquid in the peripheral direction, less product is lost upon the removal of the solid phase with the washing liquid, in accordance with the embodiments of the present disclosure.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A centrifuge having a vertical axis of rotation, the centrifuge comprising:

a rotatable drum configured to process an inflowing suspension, the rotatable drum including an assembly configured to supply a washing liquid into an interior of the drum;

at least one supply pipe arranged in the drum and configured to conduct the washing liquid into the interior of the drum, the at least one supply pipe arranged such that the washing liquid exits from the at least one supply pipe with a velocity component in a peripheral rotational direction of the drum;

wherein the drum includes a plurality of peripherally-distributed solid discharge nozzles, and the at least one supply pipe includes a plurality of supply pipes corresponding to the plurality of peripherally-distributed solid discharge nozzles; and wherein the plurality of supply pipes each have a section extending radially within the drum and a curved section adjoining thereon at a radially distal end of the supply pipes proximate an inner wall of the drum to deflect the washing liquid in the peripheral rotational direction.

2. The centrifuge according to claim 1, wherein the plurality of supply pipes each have an outlet opening including an outlet nozzle.

3. The centrifuge according to claim 1, wherein no structure lies between an inner wall of the drum and a path of the flow of the washing liquid in the peripheral rotational direction.

4. The centrifuge according to claim 1, wherein the outlet openings of the supply pipes are located in the peripheral rotational direction between the solid discharge nozzles.

5. The centrifuge according to claim 1, wherein the outlet openings of the supply pipes are each located in the peripheral rotational direction centrally between solid discharge openings and adjacent to one another.

* * * * *